United States Patent [19]

Wright, Sr.

[11] 4,002,194

[45] Jan. 11, 1977

[54] SAFETY WALLET

[76] Inventor: Charles B. Wright, Sr., 311 N. Lindbergh, St. Louis, Mo. 63141

[22] Filed: Nov. 5, 1975

[21] Appl. No.: 628,725

[52] U.S. Cl. ..... 150/47

[51] Int. Cl.[2] ..... A45C 1/06

[58] Field of Search ..... 150/38, 47; 24/DIG. 18, 24/3 H, 204; 428/88

[56] References Cited

UNITED STATES PATENTS

| | | | |
|---|---|---|---|
| 1,519,142 | 12/1924 | Lakin | 150/47 |
| 2,369,597 | 2/1945 | Miller | 150/47 |
| 2,834,389 | 5/1958 | Major | 150/47 |
| 3,374,508 | 3/1968 | Slimovitz | 150/47 X |

*Primary Examiner*—Donald F. Norton
*Attorney, Agent, or Firm*—Sughrue, Rothwell, Mion, Zinn & Macpeak

[57] ABSTRACT

A safety wallet has outer panels each having an area with material of a relatively high coefficient of friction adapted to frictionally engage with pocket fabric sides, whereby the likelihood of withdrawal of the wallet from the pocket without sensory perception of the owner is minimized.

In modified forms of the invention a series of ridges are formed in the areas having said friction material.

1 Claim, 6 Drawing Figures

SAFETY WALLET

BACKGROUND OF THE INVENTION

1. Field of the Invention

This invention pertains to personal luggage such as wallets, specifically, to a pocket wallet having features whereby withdrawal from the pocket through inadvertence or without detection is rendered very difficult.

2. Statement of the Prior Art

Devices with friction surfaces intended to alert the owner to possible theft or loss of pocket or other articles have been heretofore proposed. Representative of such proposals are the following U.S. patents:

| Patent No. | Patentee | Issue Date |
|---|---|---|
| 1,519,142 | Lakin | Dec. 16, 1924 |
| 1,632,785 | Blair | June 21, 1927 |
| 1,952,293 | Spengler | Mar. 27, 1934 |
| 2,152,133 | Brousseau | Mar. 28, 1939 |
| 2,369,597 | Miller | Feb. 13, 1945 |
| 2,807,303 | Schulhoff | Sep. 24, 1957 |
| 2,834,389 | Major | May 13, 1958 |

SUMMARY OF THE INVENTION

The present invention is directed to the provision of a safety wallet as aforesaid wherein at least one outer wallet panel is provided with a suede-like or hirsute outer surface of a color and appearance approximating that of the wallet generally, but having a relatively high coefficient of friction. This surface frictionally grips the fabric of a pocket upon attempted withdrawal of the wallet thereby alerting the owner to the fact of such attempted withdrawal.

A principal object of this invention is to provide a wallet as aforesaid wherein the general appearance of the item is not substantially affected by the safety feature, and wherein the said safety feature is provided without substantial additional expense.

Other and further objects and advantages of the invention will become apparent to those skilled in the art from a consideration of the following specification when read in conjunction with the annexed drawing.

DESCRIPTION OF THE PREFERRED EMBODIMENT

Figure 1:
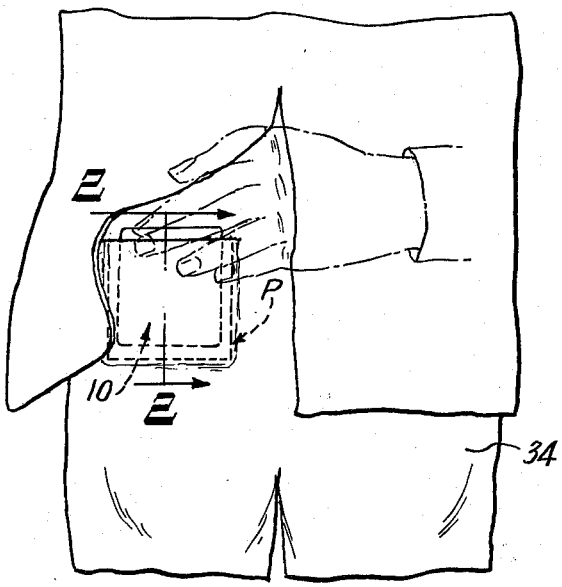
FIG. 1 shows a wallet hereof in place in a pocket and about to be withdrawn therefrom.

Referring further to the drawing, reference numeral 10 therein designates one form of wallet constructed and assembled according to this invention. The wallet 10 is of optional shape, size and interior conformation, but includes two sections, 12 and 14 connected integrally to one another at a central fold section 16. The sections 12 and 14 each have an outer panel 18 connected to the interior components of the wallet, as by lines of stitching 20. Each of the panels has an outer side edge 22, inner side edge 24, and top and bottom edges 26, 28, respectively. The outer edges and top and bottom edges are preferably crimped or rolled for appearance and durability.

The outer panels 18 are formed of leather, fabric, plastic or other substances conventionally used in wallet fabrication. Each of said panels has an exposed outer surface, described more fully hereinafter. The outer surfaces are provided with enlarged areas 30 having a coefficient of friction substantially greater than that of the surrounding rim areas 32. Such high coefficient of friction areas comprise either material patches of inherent characteristic providing increased drag or resistance to slidable movement, as for example suede leather or similar hirsute substance, or areas of the material of fabrication per se which have been subjected to mechanical or chemical operations providing such characteristics.

Figure 2:
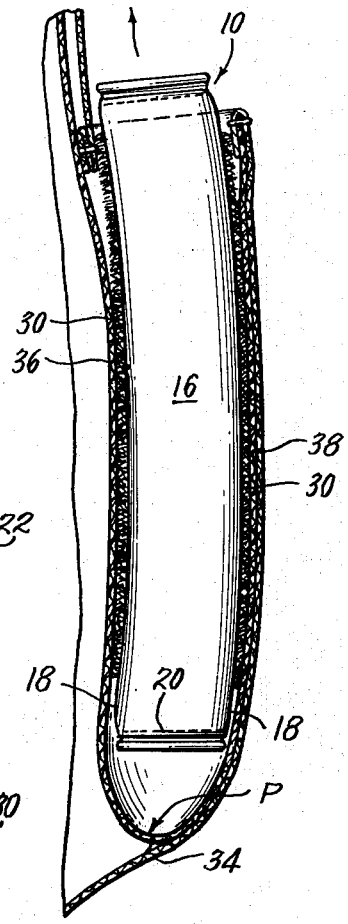
FIG. 2 is an enlarged sectional view taken on line 2—2 of FIG. 1, looking in the direction of the arrows.
Figure 3:
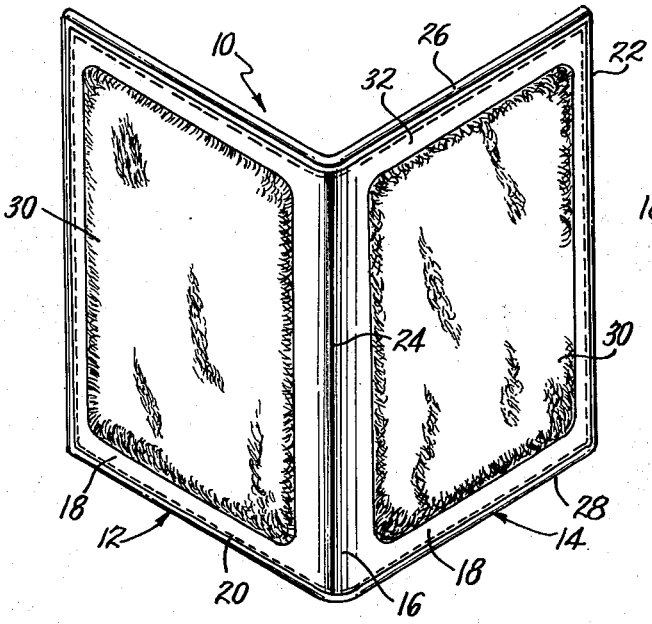
FIG. 3 is a perspective view of the wallet showing the exposed panel surfaces.

In either event, in operation, the wallet 10 is normally positioned in a pocket P in the trouser 34 of the wearer. The pocket includes fabric pocket side panels 36 and 38. In FIG. 2, it will be observed that the areas 30 establish an affinity to said fabric, whereby upon attempted withdrawal of the wallet, the wearer is alerted to a tugging or pulling against the pocket side panels. In such event, unauthorized removal as illustrated for example in FIG. 1 by a pickpocket or the like would be known to the wallet owner and such unauthorized removal could be prevented.

Figure 4:
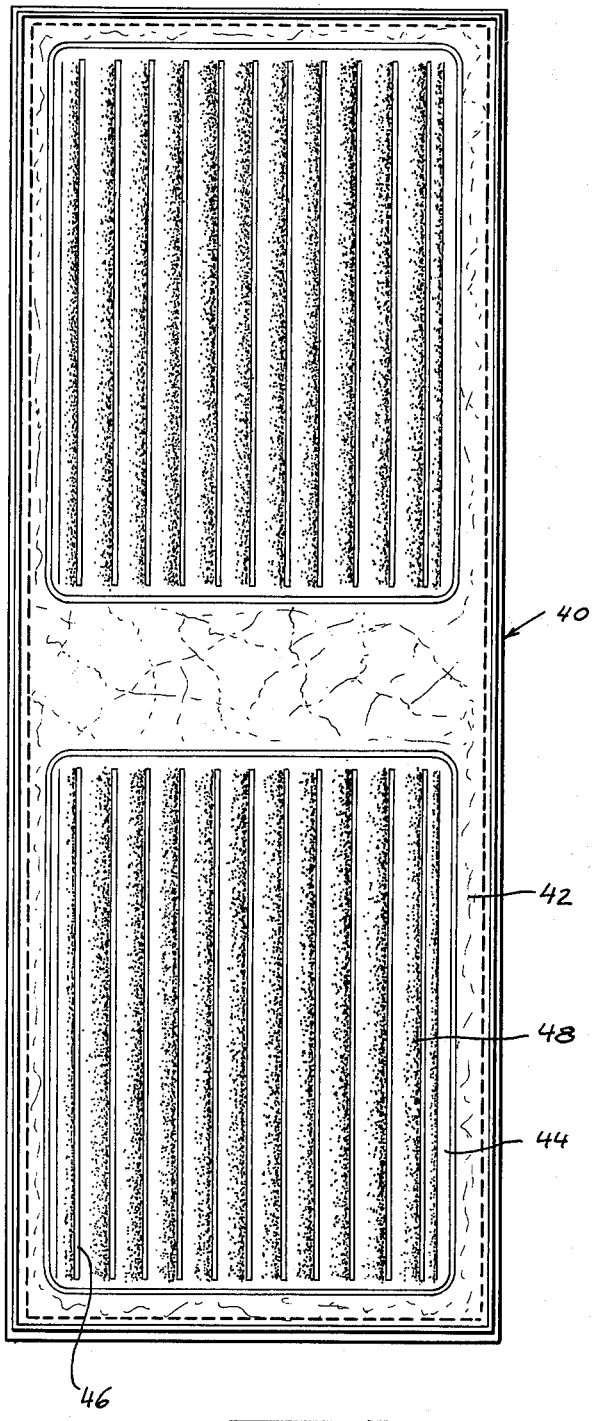
FIG. 4 is a plan view of a first modified form of the invention.
Figure 6:
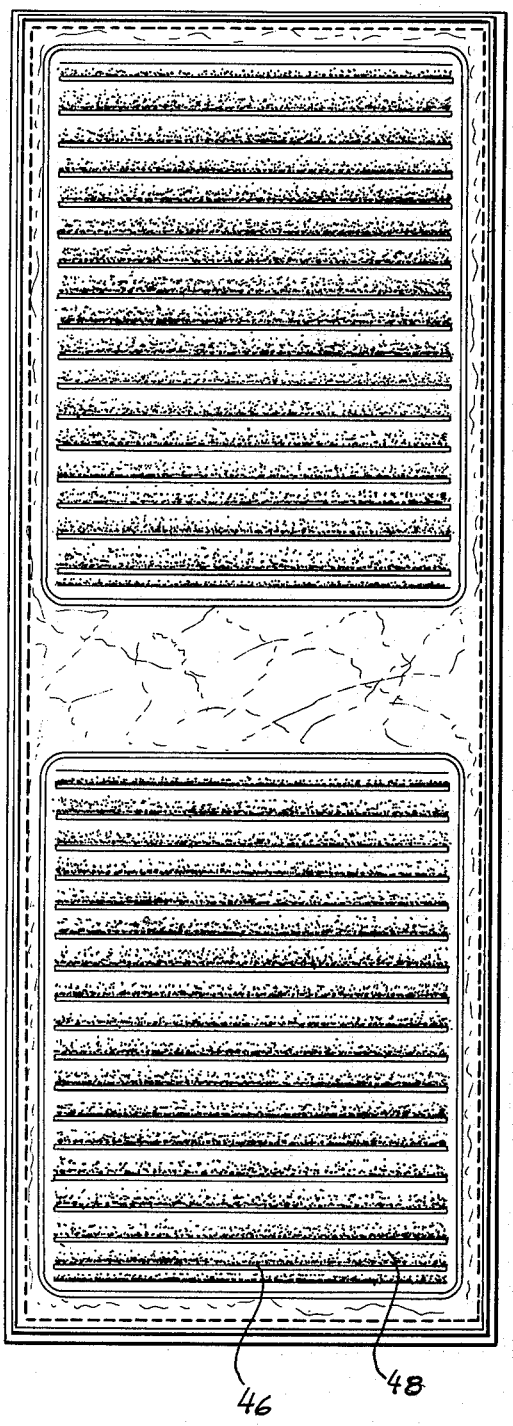
FIG. 6 is a plan view of another modification.
Figure 5:
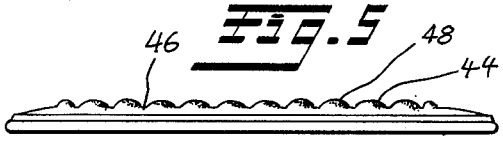
FIG. 5 is an end elevational view of the form shown in FIG. 4.

Referring to FIGS. 4 and 5 a wallet 40 has outer side panels 42 with raised areas 44 constructed of the aforesaid material of high friction. Formed in said areas are a series of indented lines 46. The lines are formed as with a heat press, and create upstanding ridges 48 therebetween. Other and different means of treating or ridging the material may of course be used. The effect of the outward extension of the ridges is to increase the likelihood of frictional contact with the pocket panels. In a second, similar modified form, FIG. 6, the lines are shown extending transversely of the panels rather than longitudinally, for the same purpose.

I claim:

1. A safety wallet for retention in a fabric pocket having pocket side panels, the wallet comprising:

a pair of wallet sections connected to one another at a fold section;

each of said sections being generally rectangular in form and having an outer panel with an exposed surface and with side and end edges;

each of said exposed surfaces having a substantially rectangular area of a dimension such as to be closely adjacent the side and end edges of the respective sections and to substantially cover said sections;

the sections having rim portions surrounding the areas with a relatively low coefficient of friction in relation to that of the rectangular areas;

the rectangular areas having a plurality of closely spaced, outstanding, randomly directed, hirsute surface protuberances thereon;

said rectangular areas further comprising a plurality of heat pressed, integral, indented lines extending essentially parallel to each other from edge to edge to form integral, parallel hirsute ridges;

whereby, said hirsute surface protuberance ridges being soft and flexible provide a high and substantially equal coefficient of sliding friction in all directions in localized fashion between the heat pressed indented lines on respective pocket side panels to prevent inadvertent loss of the wallet and to prevent unauthorized withdrawal of the wallet from the pocket.

* * * * *